US010465708B2

(12) United States Patent
Clemen et al.

(10) Patent No.: US 10,465,708 B2
(45) Date of Patent: Nov. 5, 2019

(54) DIFFUSER PART FOR A GAS TURBINE

(71) Applicant: Rolls-Royce Deutschland Ltd & Co KG, Blankenfelde-Mahlow (DE)

(72) Inventors: Carsten Clemen, Mittenwalde (DE); Ivo Szarvasy, Berlin (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 546 days.

(21) Appl. No.: 15/212,791

(22) Filed: Jul. 18, 2016

(65) Prior Publication Data

US 2017/0023014 A1 Jan. 26, 2017

(30) Foreign Application Priority Data

Jul. 20, 2015 (DE) ..... 10 2015 213 625

(51) Int. Cl.
*F04D 29/54* (2006.01)
*F01D 9/02* (2006.01)
(Continued)

(52) U.S. Cl.
CPC ..... *F04D 29/541* (2013.01); *F01D 9/02* (2013.01); *F01D 25/26* (2013.01); *F04D 29/322* (2013.01); *F23R 3/04* (2013.01); *F05B 2220/302* (2013.01); *F05B 2230/237* (2013.01); *F05B 2240/35* (2013.01); *F05B 2250/11* (2013.01); *F05B 2250/121* (2013.01); *F05B 2250/132* (2013.01); *F05B 2250/283* (2013.01); *F05B 2260/96* (2013.01); *F05D 2240/35* (2013.01); *F05D 2250/11* (2013.01); *F05D 2250/12* (2013.01); *F05D 2250/13* (2013.01);
(Continued)

(58) Field of Classification Search
CPC ..... F04D 29/541; F01D 9/02; F01D 25/26; F23R 3/04
USPC ..... 415/207
See application file for complete search history.

(56) References Cited

U.S. PATENT DOCUMENTS 5,462,088 A * 10/1995 Poux ..... F01D 25/30 138/39
9,514,734 B1 * 12/2016 Jones ..... G10K 11/172
(Continued)

FOREIGN PATENT DOCUMENTS

DE 69302989 T2 10/1996
DE 102012215413 A1 3/2014
(Continued)

OTHER PUBLICATIONS

German Search Report dated Jul. 20, 2015 for counterpart German application No. DE 10 2015 213 625.6.
(Continued)

*Primary Examiner* — Aaron R Eastman
(74) *Attorney, Agent, or Firm* — Shuttleworth & Ingersoll, PLC; Timothy J. Klima

(57) ABSTRACT

A diffuser component for a gas turbine is provided, where a fluid flow in the direction of a combustion chamber of the gas turbine can be slowed down by the diffuser component, and a flow cross-section of the diffuser component, which is defined by a diffuser wall is widened to do so. The diffuser wall is at least locally braced, in that at least one stiffening element with a lattice-type structure is provided on the diffuser wall.

14 Claims, 9 Drawing Sheets

(51) Int. Cl.
*F01D 25/26* (2006.01)
*F23R 3/04* (2006.01)
*F04D 29/32* (2006.01)

(52) U.S. Cl.
CPC .... *F05D 2250/14* (2013.01); *F05D 2250/141* (2013.01); *F05D 2250/283* (2013.01); *F05D 2250/324* (2013.01); *F05D 2260/941* (2013.01)

(56) References Cited

U.S. PATENT DOCUMENTS

2005/0095127 A1* 5/2005 Sasu ..... F01D 9/045 415/208.4
2005/0194210 A1* 9/2005 Panossian ..... B32B 3/12 181/293
2014/0202789 A1* 7/2014 Heurtaux ..... G10K 11/172 181/292
2014/0338304 A1* 11/2014 Schilp ..... F01D 9/023 60/39.23
2016/0290647 A1* 10/2016 Propheter-Hinckley ..... F23R 3/002
2017/0001708 A1* 1/2017 Alonso-Miralles ..... B64C 1/40
2018/0050422 A1* 2/2018 Fong ..... B23K 26/342
2018/0135515 A1* 5/2018 Fung ..... F02C 7/045

FOREIGN PATENT DOCUMENTS

WO WO2015031796 A1 3/2015
WO WO2016036631 A1 3/2016

OTHER PUBLICATIONS

European Search Report dated Nov. 21, 2016 for counterpart European Application No. 16179766.7.

* cited by examiner

State of the Art

State of the Art

DIFFUSER PART FOR A GAS TURBINE

CROSS REFERENCE TO RELATED APPLICATION

This application claims priority to German Patent Application No. 10 2015 213 625.6 filed on Jul. 20, 2015, the entirety of which is incorporated by reference herein.

BACKGROUND

This invention relates to a diffuser component for a gas turbine.

Using a diffuser component of this type, a fluid flow in the direction of a combustion chamber of a gas turbine, in particular of a gas-turbine engine, can be slowed down, where a flow cross-section of the diffuser component is widened to do so. The flow cross-section of the diffuser component is defined here by a diffuser wall which extends from an inlet of the diffuser component in the direction of an outlet of the diffuser component, such that the flow cross-section widens continuously or non-continuously in the direction of the outlet.

Inside a gas-turbine engine, a diffuser component of this type forms for example part of an axial diffuser at the end of a (high-pressure) compressor downstream of an outlet guide vane. The diffuser component is here typically connected upwards to a combustion chamber casing and a compressor casing, and downwards to an inner combustion chamber casing. Starting from the outlet of the diffuser component, air then flows in particular to a combustion chamber of the gas-turbine engine and here, for example, to a combustion chamber flame tube defining a combustion space.

Usually, the diffuser wall is at most locally connected to the combustion chamber casings and to the compressor casing. A part of the diffuser wall is thus not supported on the respective casing. At least one section of the diffuser component can also project with its diffuser wall into the combustion chamber. It can thus occur during operation of the gas turbine that the diffuser wall starts to vibrate. Vibration of this type can however in some circumstances lead to tearing away of part of the diffuser wall during operation.

An increase in the strength, and in particular in the fatigue strength, of the diffuser component by designing the diffuser wall with an increased wall thickness is as a rule not desirable here. On the one hand, the possibility for an increased thickness may be limited by the installation space available, and on the other hand, an increased thickness would considerably increase the weight of the diffuser component.

SUMMARY

Proceeding from this problem, the object underlying the present invention is to further improve a diffuser component for a gas turbine and in particular to increase its strength at those stresses occurring during operation, without having to considerably increase the weight of the diffuser component to do so.

Solution is provided by a diffuser component as described herein.

In accordance with the invention, the diffuser wall of the diffuser component is at least locally braced, in that at least one stiffening element with a lattice-type structure is provided on the diffuser wall. The diffuser wall is braced by its lattice-type structures such that it does not easily start to vibrate. By providing the at least one stiffening element with a lattice-type structure and not designing it solid, bracing of the diffuser wall using the stiffening element results in only a comparatively low additional weight.

The stiffening element with the lattice-type structure can be integrally designed with the diffuser wall or be subsequently fixed to the diffuser wall as a separate component. The diffuser component and/or the at least one stiffening element can here for example be cast.

In the lattice-type structure of the at least one stiffening element, individual cells or compartments can be formed by (transverse and longitudinal) struts running at angles to one another. As a result, the individual cells can have for example a rectangular, triangular, trapezoidal, diamond-shaped or honeycomb-shaped base area in their cross-section. A honeycomb-shaped base area is understood here in particular as a base area of the cell formed by a preferably regular pentagon or hexagon. The at least one stiffening element can thus also form a honeycomb-like lattice structure in one exemplary embodiment. The lattice-type structure of the at least one stiffening element can furthermore also provide cells with a base area having a circular or elliptical cross-section.

It is by no means compulsory here that the individual cells of the lattice-type structure of the at least one stiffening element be designed identical to one another; cells of geometrically differing design and/or cells of differing size can also be provided on the lattice-type structure in order to provide stronger bracing, for example in areas of the diffuser wall subject to higher stresses, e.g. by using smaller cells adjacent to one another.

It can also be provided that the stiffening element protrudes from the diffuser wall as the height changes. Accordingly, the lattice-type structure of the stiffening element is for example higher locally than at another area along the diffuser wall. It is thus possible, for example due to a swirl imparted to the fluid flow, that an area of the diffuser wall, for example in the zone of the outer combustion chamber casing, is subjected to higher stress, so that the stiffening element is designed thicker here than in other areas of the diffuser wall. A further reason for locally differing heights of the stiffening element or differing heights or thicknesses on an inner side and an outer side of the diffuser wall can be differing thermal expansions inside the component.

Generally speaking, it can be provided that the stiffening element is designed completely enclosing a circumference of the diffuser wall. The stiffening element thus extends with its lattice-type structure for example like a sleeve along the outer side of the diffuser wall. In particular, it can be provided in this connection that the stiffening element extends over the entire surface area of the diffuser wall. It is also possible here for the stiffening element to extend over a diffuser wall inner surface area that faces the fluid flow. Due to the possibly disruptive effect of the lattice-type structure on the flow behaviour, it is preferred as a rule that the stiffening element extends over the outer surface area of the diffuser wall.

However, the stiffening element does not of course have to cover the entire diffuser wall with its lattice-type structure, for example on its outer side; it can also be provided that the stiffening element extends over only part of the diffuser wall. It is thus provided in one exemplary embodiment that for further weight optimization the at least one stiffening element does not extend over the entire length of the diffuser wall from an inlet of the diffuser to an outlet of the diffuser. For example, the diffuser wall is only locally braced by the stiffening element with its lattice-type structure. In an alternative design variant, however, the stiffening element extends with its lattice-type structure at least over a major part of the length (more than 60% of the length) of the diffuser wall, to brace it preferably over a large area.

In one design variant, at least two stiffening elements spatially separated from one another and each having at least one lattice-type structure can be provided on the diffuser wall. Using several (at least two) stiffening elements separated from one another, the bracing effect can be adapted even better to the stresses occurring during operation. For example, for this purpose at least two stiffening elements are provided on the diffuser wall which

- protrude with differing heights from the diffuser wall and/or
- have different lengths and/or widths and/or
- have lattice-type structures with cells differing in their geometry and/or size.

If necessary, at least two stiffening elements can also be provided on the diffuser wall, in several layers one above the other and hence at least partially overlapping. However, this is only favoured in exceptional cases for weight reasons and due to the considerably greater installation height as a result of the overlapping lattice-type structures. Using lattice-type structures arranged one above the other in sandwich form and for example also having cells of geometrically differing design, the strength of the diffuser wall can however be considerably increased if required, with the overall thickness of the diffuser wall with its lattice-type structures still being significantly lower than would be the case with a solid diffuser wall of equal strength.

The at least two stiffening elements spatially separated from one another can generally speaking be arranged adjacently along an extension direction of the diffuser wall pointing from an inlet of the diffuser to an outlet of the diffuser, one behind the other and/or transversely to said extension direction.

As already explained above, the at least one stiffening element is preferably provided on an outer side of the diffuser wall facing away from the fluid flow. At least one additional flat stiffening element can be arranged on the lattice-type structure in particular for attaching or providing the stiffening element with its lattice-type structure on an inner side of the diffuser wall that faces the fluid flow, without thereby having a disruptive effect on the fluid flow. An additional flat stiffening element of this type then covers at least part of the lattice-type structure and forms a plane inner surface facing the fluid flow.

In an alternative design variant, the additional flat stiffening element is arranged on a lattice-type structure of a stiffening element that extends over the outer side of the diffuser wall facing away from the fluid flow. It is thus possible with the additional flat stiffening element (in addition) to absorb axial forces—relative to the flow direction of the fluid inside the diffuser component—that occur at the diffuser wall during operation of the gas turbine. Accordingly, the arrangement of an additional flat stiffening element both on the inner side and on the outer side of the diffuser wall can be advantageous if a lattice-type structure is also provided here in each case.

The at least one additional flat (second) stiffening element can extend over the entire lattice-type structure of the (first) stiffening element and cover its full surface or only part of the lattice-type structure.

By means of the additional flat stiffening element, it is possible—here too only locally if required—for a sandwich-type stiffening structure to be provided on the diffuser component. The lattice-type structure of the first stiffening element extends here at least partially between the inner or outer sides of the diffuser wall and the additional flat second stiffening element.

In a possible design variant, the at least one additional stiffening element is provided with a thin metal sheet or designed in the form of a thin metal sheet. The wall thickness of this sheet is here preferably considerably less than the wall thickness of the diffuser wall. For example, the wall thickness of the thin sheet is at most 30% of the wall thickness of the diffuser wall.

An additional flat stiffening element arranged as a separate component on the stiffening element with the lattice-type structure is for example welded or brazed on.

In a preferred embodiment, a diffuser component in accordance with the invention forms a component of a gas-turbine engine and during operation of the gas-turbine engine guides a fluid flow in the direction of a combustion chamber of the gas-turbine engine.

BRIEF DESCRIPTION OF THE DRAWINGS

Further advantages and features of the present invention become apparent from the following description of exemplary embodiments shown in the figures.

DETAILED DESCRIPTION

Figure 1A:
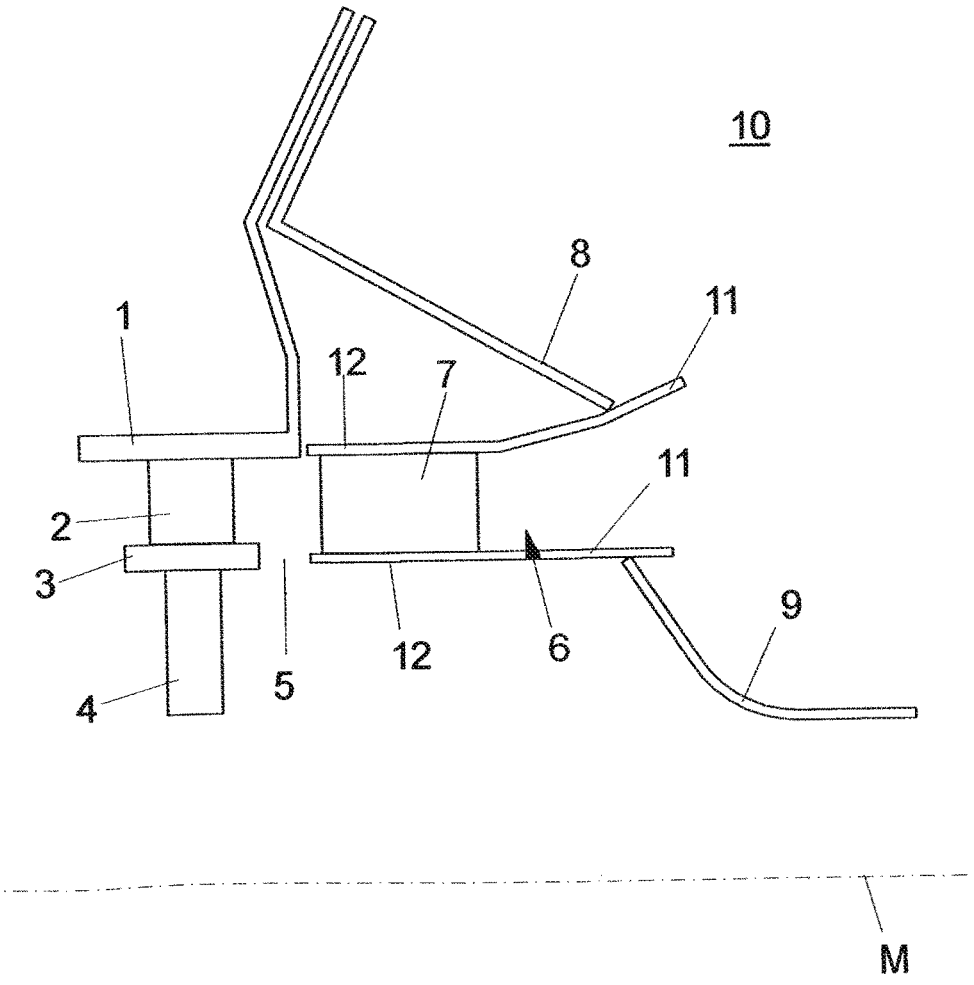
FIGS. 1A to 1B show schematically in different views a diffuser component known from the state of the art in a condition installed in a gas-turbine engine.
Figure 1B:
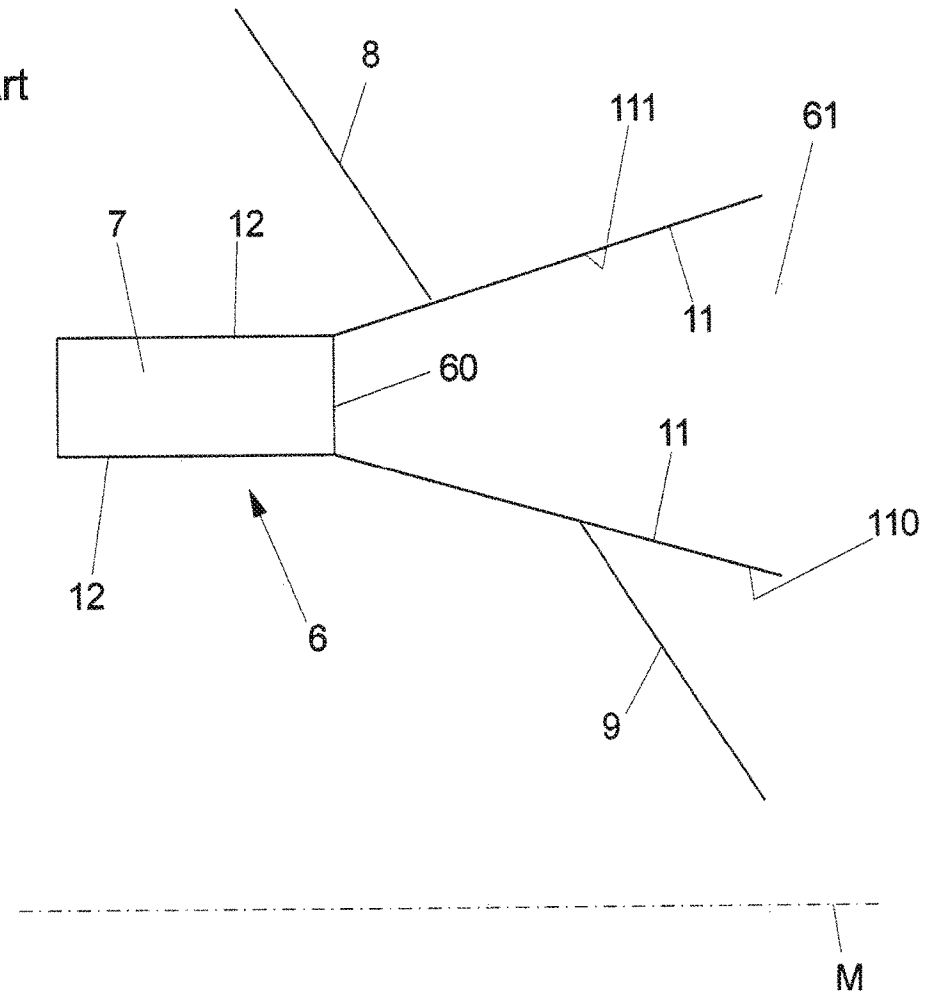

FIGS. 1A and 1B each show in a sectional view a diffuser component known from the state of the art in the form of a diffuser 6 in a gas-turbine engine. FIG. 1A illustrates schematically in a sectional view the installation situation of the diffuser 6, while FIG. 1B shows an enlarged view of this installation situation. The diffuser 6, designed here as an axial diffuser, is arranged downstream of a compressor rotor stage of the gas-turbine engine and guides an airflow coming from the latter in the direction of a combustion chamber 10 of the gas-turbine engine. FIG. 1A shows here in particular a compressor casing 1, an outlet guide vane 7, the diffuser 6 and parts of the casing of the combustion chamber 10, which are arranged one behind the other along an engine axis M. A compressor rotor disk 4 with compressor rotor hub 3 and compressor rotor 2 is rotatably mounted inside the compressor casing 1. These components form here parts of a high-pressure compressor via which a fluid flow is guided in the direction of an outlet guide vane 7. The fluid flow generated passes here via a gap 5 between the compressor rotor 2 and the outlet guide vane 7 into a casing section for the outlet guide vane 7. The outlet guide vane 7 used to direct the fluid flow is here enclosed between outlet guide vane outer walls 12.

The diffuser 6 is arranged downstream of the outlet guide vane 7. The fluid flow is slowed down by this diffuser 6, in that a flow cross-section defined by the diffuser wall 11 widens in the direction of the combustion chamber 10 starting from an inlet 60 of the diffuser 6 to an outlet 61 of the diffuser 6. The diffuser wall 11 of the diffuser 6 here faces the fluid flow on an inner surface area or inner side 111. On an opposite outer side 110 of the diffuser wall 11, said diffuser wall 11 is connected on the one hand to an outer combustion chamber casing 8 and on the other hand to an inner combustion chamber casing 9.

With the embodiment and arrangement of a diffuser 6 as shown and known from the state of the art, the diffuser wall 11 can during operation of the gas-turbine engine be excited to unwelcome vibrations, which can ultimately even lead to tearing away of the diffuser wall 11 or a part thereof.

Figure 2A:
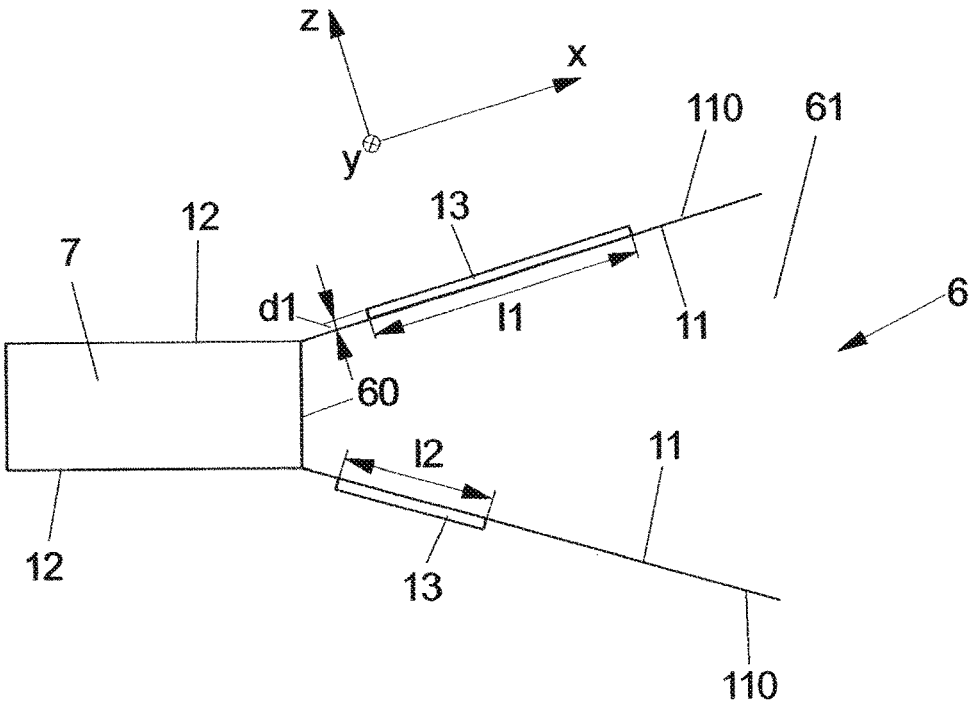
FIGS. 2A to 2C show three different design variants of a diffuser component in accordance with the present invention, each in sectional view and schematically, and each having at least one stiffening element.
Figure 2B:
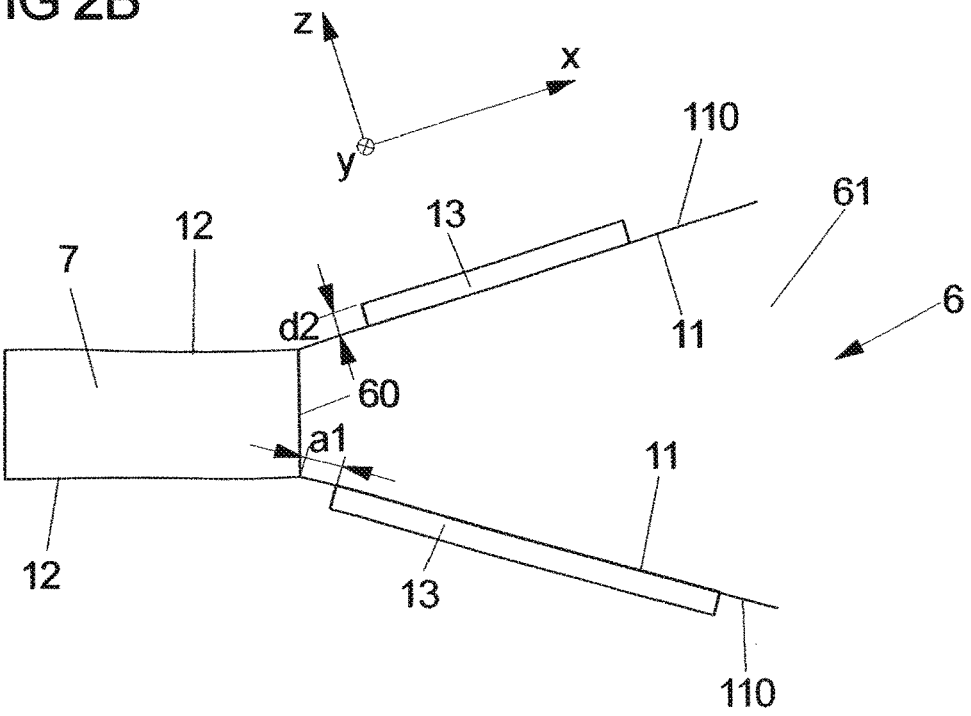
Figure 2C:
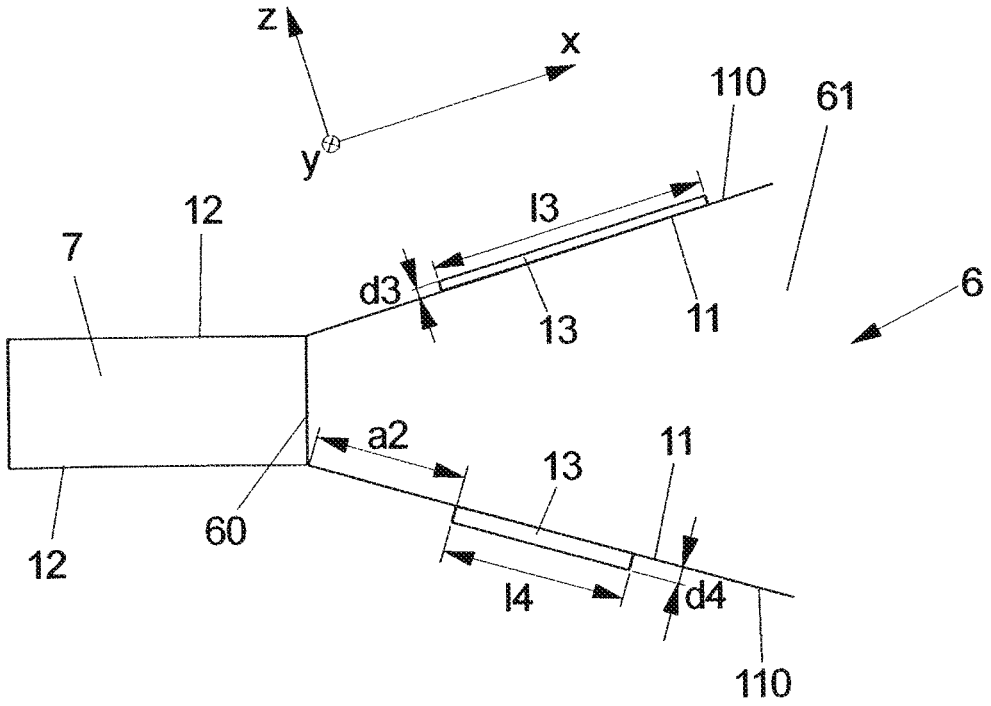

To remedy this, it is provided in the design variants in accordance with the invention of FIGS. 2A, 2B and 2C that a lattice-type stiffening structure is provided by means of a separate stiffening element 13 on the outer side 110 of a diffuser wall 11, or a stiffening element 13 of this type with a lattice-type stiffening structure is integrally designed with the outer side 110 of the diffuser wall 11. The stiffening element 13 can extend here along the full circumference of the diffuser wall 11 and also cover it in full on its outer side 110. It can however also be provided in accordance with the design variants of FIGS. 2A, 2B and 2C that a stiffening element 13 with a lattice-type structure is fixed only to a part of the diffuser walls 11 or alternatively is integral with them.

In accordance with the sectional views in FIGS. 2A, 2B and 2C, several stiffening elements 13 separated from one another can be provided along the circumference of the diffuser wall 11 and extend over the diffuser wall 11 with differing lengths l1 and l2 along an extension direction x pointing from the inlet 60 to the outlet 61 of the diffuser 6. Alternatively, it can be provided that an individual stiffening element 13 is provided with a length which changes along the circumference in the extension direction x, so that said element is then shown for example in the sectional view of FIG. 2A with a length l1 in an upper area of the diffuser wall 11 and with a shorter length l2 in an opposite lower area of the diffuser wall 11.

As can be discerned in a comparison of FIGS. 2A and 2B, a height d1 or d2 of the stiffening element 13, by which the lattice-type structure of the respective stiffening element 13 protrudes from the outer side 110 of the diffuser wall 11, can also be varied depending on requirements.

According to FIGS. 2B and 2C when viewed together, a distance a1 or a2 of a stiffening element 13 from the inlet 60 of the diffuser 6 can also be varied. For example, when the diffuser wall 11 is connected to the inner and outer combustion chamber casings 8 and 9 close to the inlet, it can be provided that above all that area of the diffuser wall 11 close to the outlet is braced using the at least one stiffening element 13, in order to prevent unwelcome vibrations.

It can be further discerned from FIG. 2C that not only the length l3 or l4 of a stiffening element 13 and its lattice-type structure along the extension direction x is variable; it can also be seen from this Figure that a stiffening element 13 with a height d3, d4 that changes along the circumference can also be provided on the diffuser wall 11, or at least two stiffening elements 13 with differing thicknesses or heights d3 and d4.

Based on FIGS. 3A to 3H, different variants for the lattice-type (stiffening) structures formed by a stiffening element 13, 13*a* or 13*b* are shown as typical examples. Each of these lattice-type structures forms, using several (transverse and longitudinal) struts 131 running at angles to one another and possibly intersecting, several cells 130, 130*a*, 130*b* and 130*c* in order to brace the diffuser wall 11 on its outer side 110. The lattice-type structures shown can of course also be curved here, in order to extend along the diffuser wall of a conical diffuser component 6. The top views of FIGS. 3A to 3H show here areas of stiffening elements 13 which extend preferably completely enclosing the circumference of the diffuser wall 11.

Figure 3B:
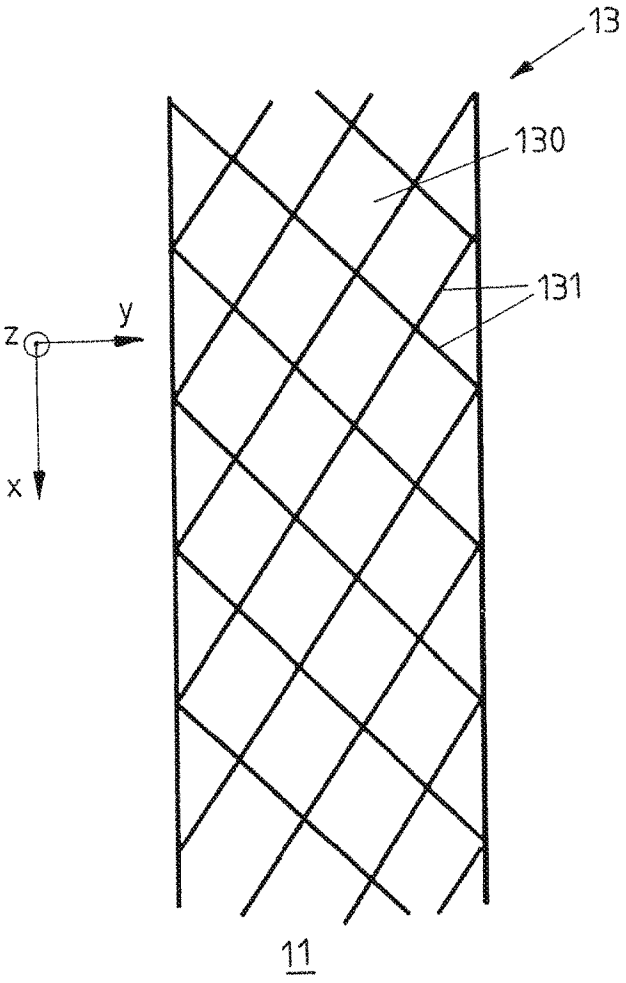
FIGS. 3A to 3H show, in top view each, a diffuser wall of a diffuser component in accordance with the present invention having differently designed stiffening elements, each of them being provided on an outer side of the diffuser wall.
Figure 3A:
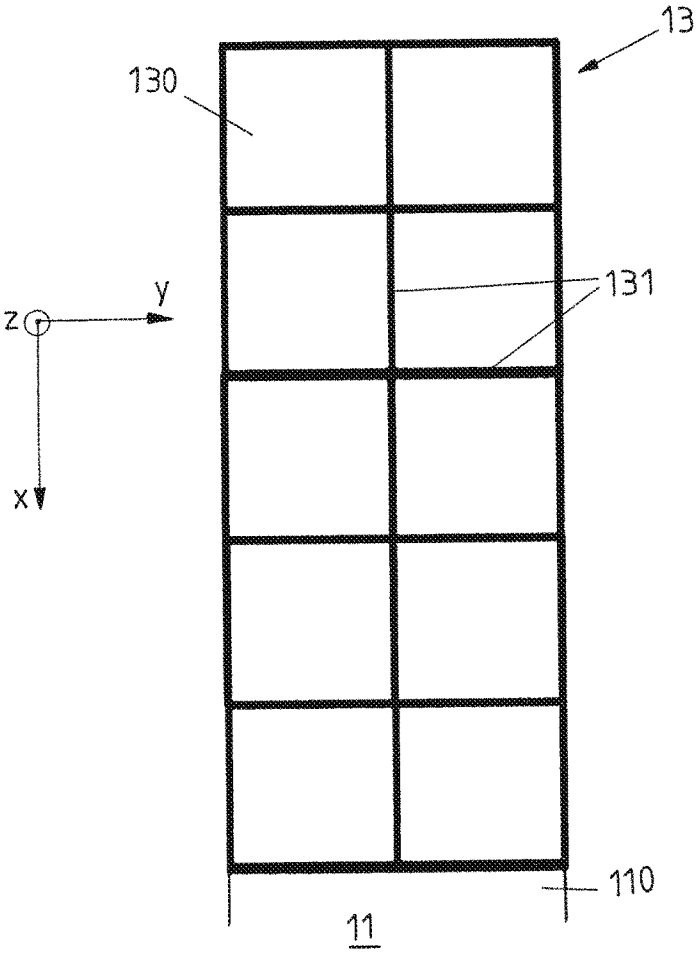

In the design variant of FIG. 3A, the stiffening element 13 forms cells 130 square in cross-section using transverse and longitudinal struts that extend parallel to one another.

In the design variant of FIG. 3B, the cells 130 formed by the lattice-type structure appear rectangular and in particular diamond-shaped.

Figure 3D:
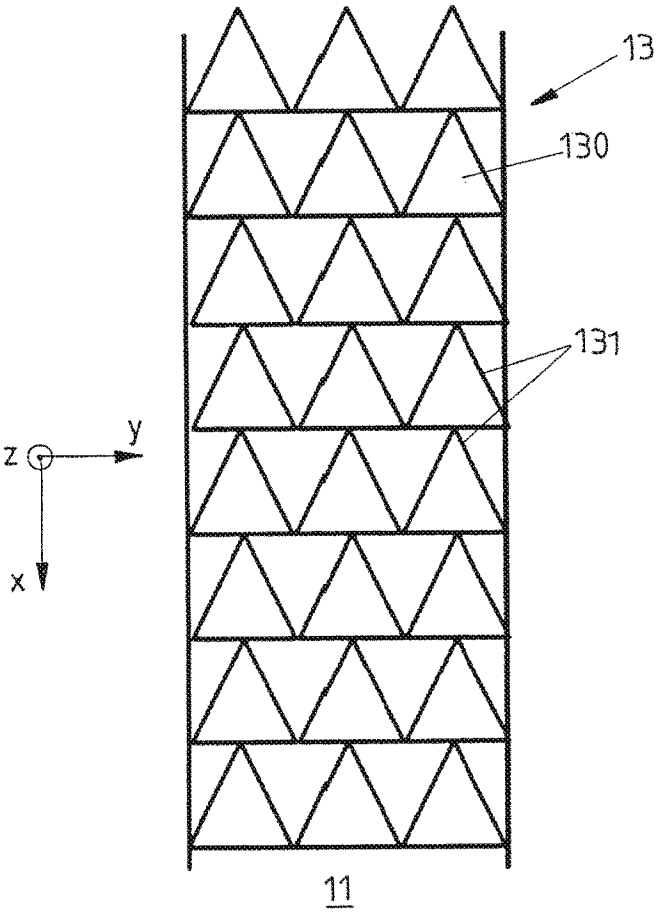
Figure 3C:
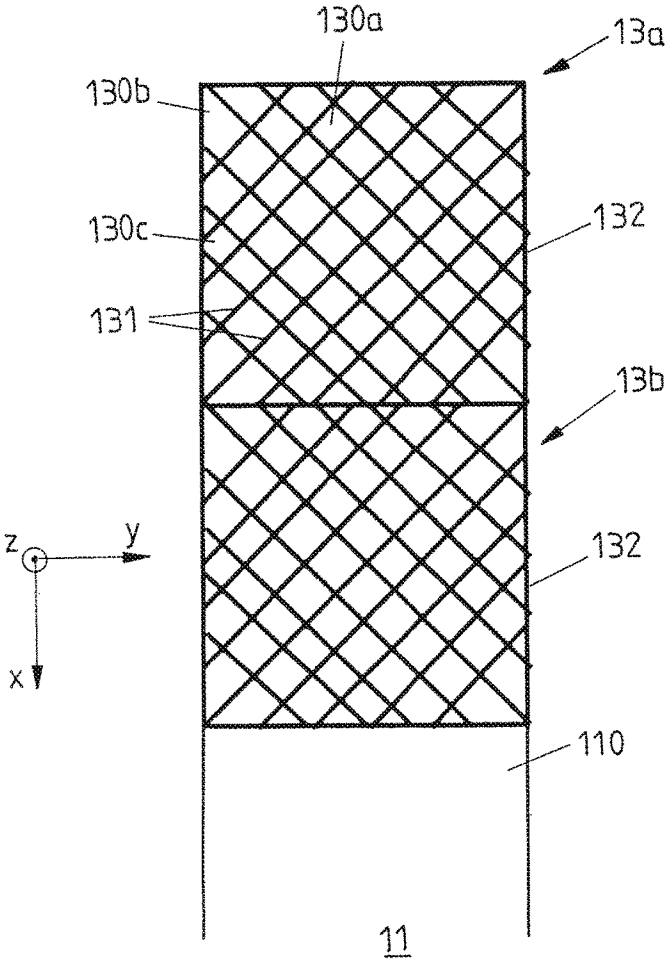

In the exemplary embodiment of FIG. 3C, two stiffening elements 13*a* and 13*b* separated from one another are provided and each form identically designed stiffening segments 132 for the diffuser wall 11. Each of these stiffening segments 132 extends over a base area rectangular in top view and forms cells 130*a*, 130*b* and 130*c* of differing geometry and differing dimensions. The individual stiffening elements 132 can be arranged here along the extension direction x of the diffuser wall 11 directly adjacent to one another or at a distance from one another and fixed to the outer side 110.

In the exemplary embodiment of FIG. 3D, the stiffening element 13 forms a lattice-type structure with triangular cells 130. Each triangular cell 130 has here a base area which is defined by an isosceles triangle.

Figure 3F:
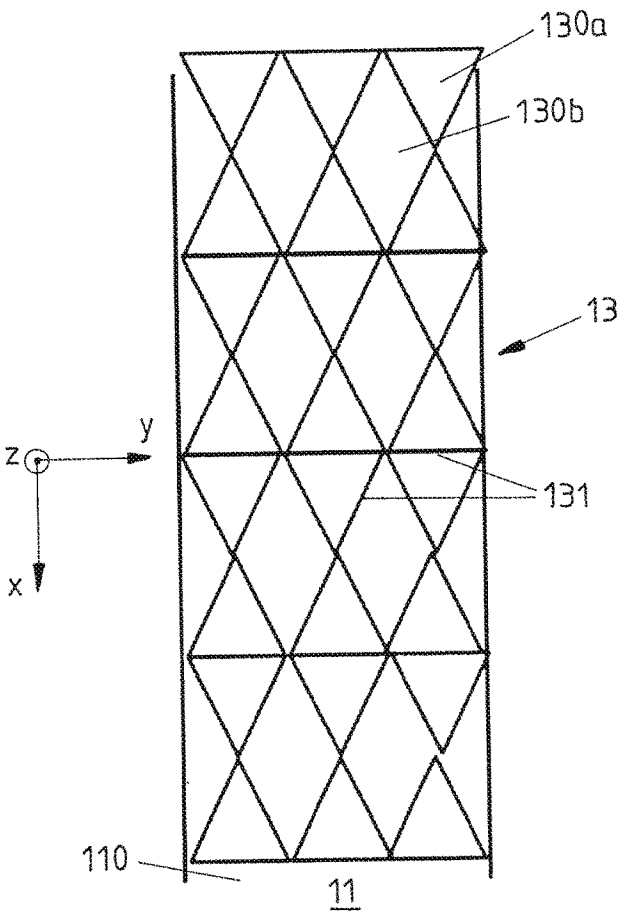
Figure 3E:
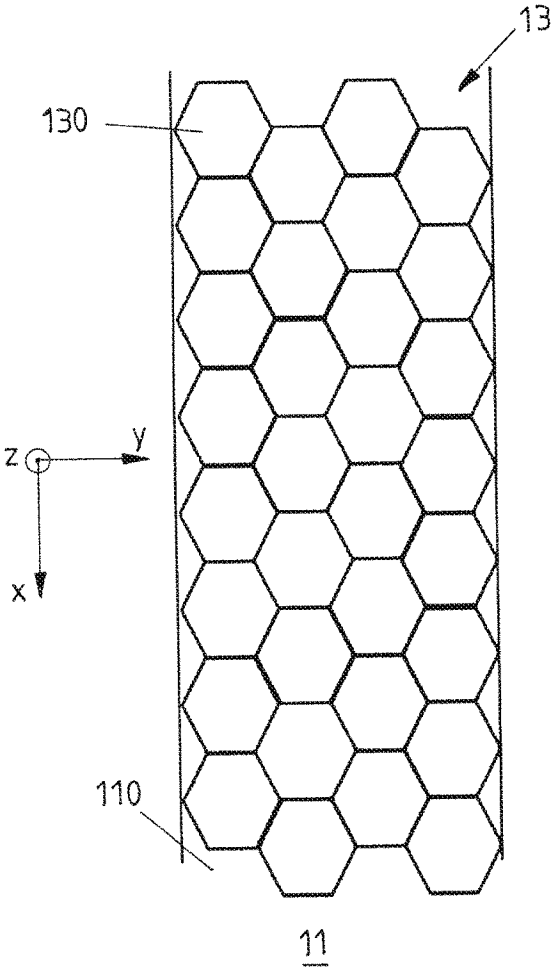

FIG. 3E illustrates a stiffening element 13 with cells 130 of honeycomb-like design. The stiffening element 13 forms here a lattice-type structure resembling bees' honeycombs, with the individual and identically designed cells 130 having a base area in the form of a regular hexagon.

In the variant of FIG. 3F, the stiffening element 13 forms a lattice structure with geometrically differing cells 130*a*, 130*b*. Individual cells 130*a* are here designed triangular in their base area, while other cells 130*b* are designed with a diamond-shaped base area.

Figure 3H:
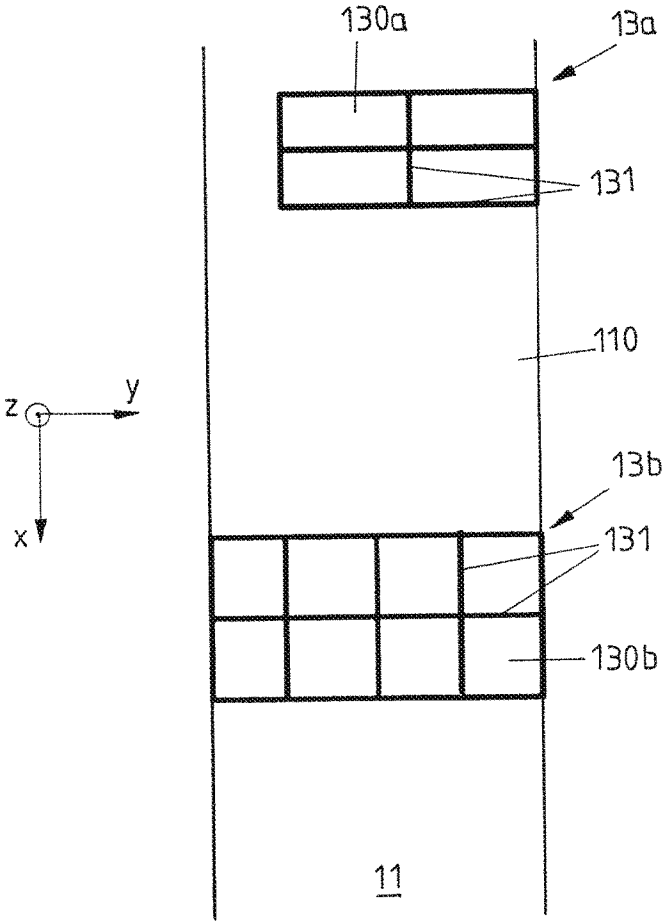
Figure 3G:
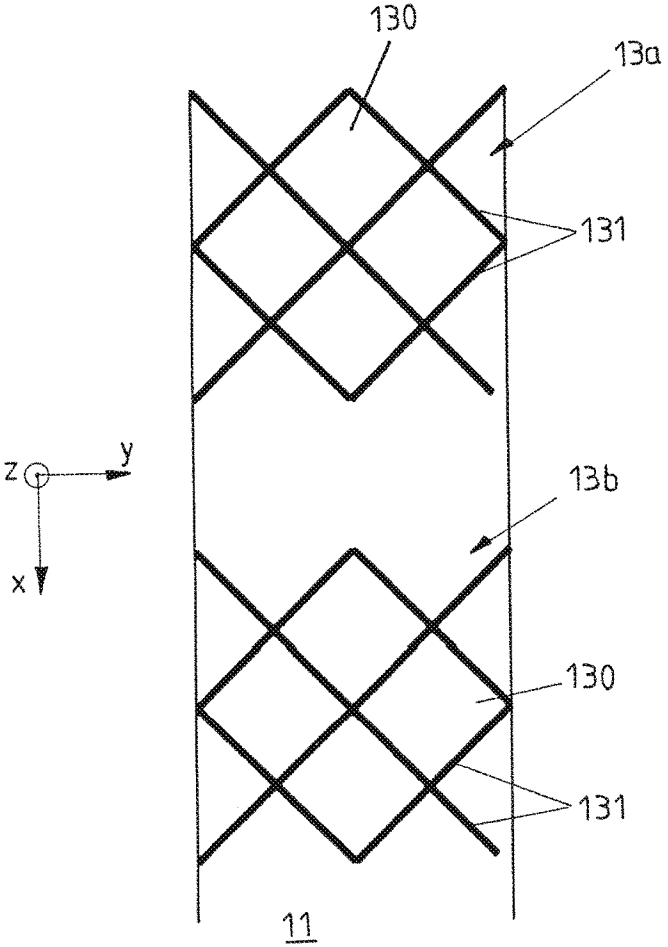

In the exemplary embodiment in FIG. 3G, stiffening elements 13*a* and 13*b* are provided at a distance from one another along the extension direction x. The lattice-type structures of these two stiffening elements 13*a* and 13*b* are however designed identical to one another and have in particular several cells 130 with a square base area.

In the exemplary embodiment of FIG. 3H, stiffening elements 13*a* and 13*b* arranged offset to one another are provided along the extension direction x and transversely thereto (along an extension direction y perpendicular thereto). These stiffening elements 13*a* and 13*b* brace the diffuser wall 11 only locally in a comparatively small area relative to the entire outer surface area of the diffuser wall 11. The individual stiffening elements 13*a* and 13*b* here form cells 130*a* and 130*b* with differing geometries. While the one stiffening element 13*a* forms cells 130*a* with rectangular cross-section, the cells 130*b* of the other stiffening element 13*b* are square in cross-section.

Figure 4B:
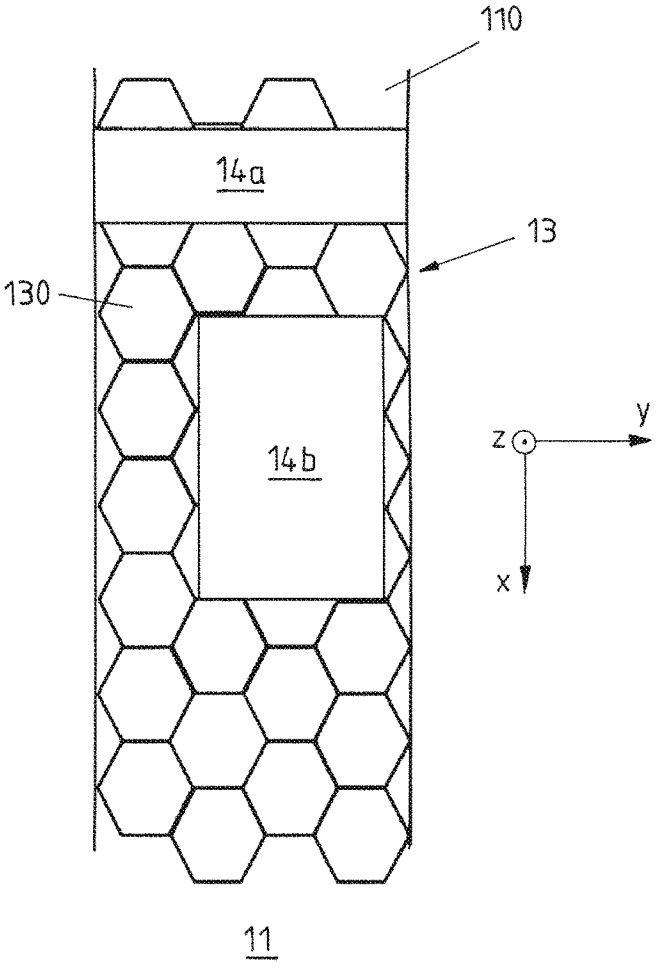
FIG. 4B shows in top view the lattice-type stiffening structure of FIG. 4A with two additional flat stiffening elements arranged on said stiffening structure.
Figure 4A:
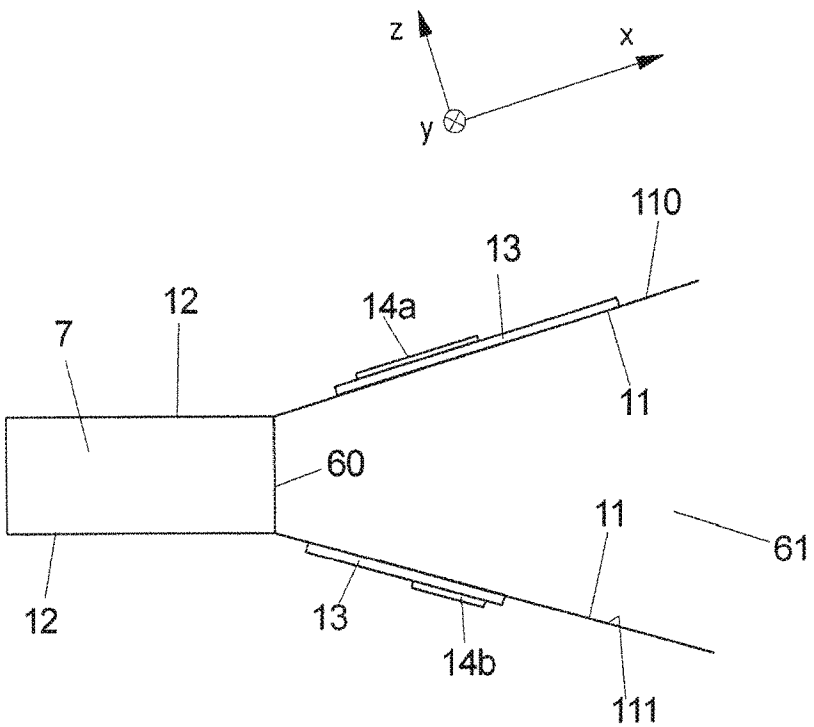
FIG. 4A shows in a view matching the FIGS. 2A to 2C a further design variant of a diffuser component in accordance with the present invention, where several flat stiffening elements are provided locally and additionally on a first lattice-type stiffening structure.

FIGS. 4A and 4B illustrate a further design variant of a diffuser component 6 in accordance with the invention. In this variant, at least one additional flat stiffening element 14*a* or 14*b* is provided additionally to at least one stiffening element 13 with lattice-type stiffening structure. An additional flat stiffening element 14*a* or 14*b* of this type is for example made from a thin metal sheet and is arranged on the lattice-type structure of a stiffening element 13, such that the respective additional flat stiffening element 14*a* or 14*b* covers at least part of the lattice-type structure. A stiffening element 14*a* or 14*b* can here be welded or brazed for example to the stiffening element 13 and its lattice-type structure.

An additional flat stiffening element 14*a* or 14*b* serves here to additionally absorb axial forces during operation of the gas-turbine engine. It is thus possible using appropriately positioned additional flat stiffening elements 14*a* or 14*b* to further brace a diffuser wall 11 locally, for example particularly in areas where an increased (vibration) stress can be expected during operation of the gas-turbine engine.

While the stiffening elements 13, 13*a* and 13*b* shown in the attached Figures are all provided on an outer side 110 and hence on an outer surface area of the diffuser wall 11, it can nevertheless be provided in one variant that one stiffening element 13, 13*a* or 13*b* or several stiffening elements 13, 13*a* or 13*b* are (also) provided on an inner side 111 of the diffuser wall 11 facing the fluid flow or are integral therewith. To prevent here a disruptive effect on the fluid flow by the compartments or cells 130, 130*a*, 130*b* or 130*c* of the respective lattice-type structure during operation, an additional flat stiffening element 14*a*, 14*b* or several additional flat stiffening elements 14*a*, 14*b* can be provided to cover the lattice-type structure(s). A plane inner surface of the additional stiffening element 14*a*, 14*b* then faces the fluid flow.

LIST OF REFERENCE NUMERALS

1 Compressor casing
10 Combustion chamber
11 Diffuser wall
110 Outer side
111 Inner side
12 Outlet guide vane outer wall
13, 13*a*, 13*b* Stiffening element
130, 130*a*, 130*b*, 130*c* Cell
131 Strut
132 Stiffening segment
14*a*, 14*b* Additional flat stiffening element
2 Compressor rotor
3 Compressor rotor hub
4 Compressor rotor disk
5 Gap between rotor and outlet guide vane
6 Diffuser
60 Inlet
61 Outlet
7 Outlet guide vane
8 Outer combustion chamber casing
9 Inner combustion chamber casing
a1, a2 Distance
d1, d2, d3, d4 Thickness/height
l1, l2, l3, l4 Length
M Engine axis
x, y, z Extension direction

The invention claimed is:

1. A diffuser component for a gas turbine, comprising:

a diffuser wall defining a flow cross-section, the flow cross-section increasing in area in a flow direction toward a combustion chamber of the gas turbine to slow a fluid flow through the flow cross-section toward the combustion chamber;

at least one stiffening element including a lattice structure connected to the diffuser wall, the at least one stiffening element bracing a section of the diffuser wall;

wherein the at least one stiffening element is positioned on an outer side of the diffuser wall that faces away from the fluid flow.

2. The diffuser component in accordance with claim 1, wherein the lattice structure includes individual cells formed by struts running at angles to one another.

3. The diffuser component in accordance with claim 2, wherein the individual cells have at least one chosen from geometrically differing shape and differing size.

4. The diffuser component in accordance with claim 1, wherein the lattice structure includes individual cells having cross-sections shaped as at least one chosen from rectangular, triangular, trapezoidal, circular, elliptical, diamond and honeycomb.

5. The diffuser component in accordance with claim 1, wherein the at least one stiffening element protrudes at a height from the diffuser wall, and the height varies along the diffuser wall.

6. The diffuser component in accordance with claim 1, wherein the at least one stiffening element completely encloses a circumference of the diffuser wall.

7. The diffuser component in accordance with claim 6, wherein the at least one stiffening element extends over more than 60% of a length of the diffuser wall.

8. The diffuser component in accordance with claim 1, wherein the at least one stiffening element extends over only part of the diffuser wall.

9. The diffuser component in accordance with claim 1, wherein the at least one stiffening element includes two stiffening elements spatially separated from one another, with each including a lattice structure on the diffuser wall.

10. The diffuser component in accordance with claim 9, wherein the two stiffening elements are arranged along an extension direction of the diffuser wall pointing from an inlet of the diffuser to an outlet of the diffuser, and at least one chosen from one behind the other and transversely to the extension direction.

11. The diffuser component in accordance with claim 9, wherein the two stiffening elements have at least one chosen from A), B) and C) where:

A) is differing heights of protrusion from the diffuser wall;

B) is at least one chosen from different lengths and different widths;

C) is lattice structures with cells differing in at least one chosen from geometry and size.

12. The diffuser component in accordance with claim 1, and further comprising at least one additional flat stiffening element arranged on the at least one stiffening element.

13. The diffuser component in accordance with claim 12, wherein the at least one additional stiffening element is at least one chosen from provided with a thin metal sheet and welded or brazed to the stiffening element.

14. A gas turbine including the diffuser component in accordance with claim 1, and during operation of the gas turbine, the fluid flow is guided through the diffuser component in the direction of the combustion chamber.

* * * * *